United States Patent [19]

Mori

[11] 3,940,865

[45] Mar. 2, 1976

[54] PLATE FOR INDICATING THE FLOORS AND THE NUMBERS OF STAIRS OF A BUILDING

[76] Inventor: Toshio Mori, Dainimiharuso, No. 81, Iguchi, Mitaka, Tokyo 181, Japan

[22] Filed: July 10, 1974

[21] Appl. No.: 487,071

[30] Foreign Application Priority Data

July 21, 1973 Japan ..... 48-84685[U]

[52] U.S. Cl. ..... 40/134; 35/7 R; 40/125 R

[51] Int. Cl.[2] ..... G09F 13/20

[58] Field of Search ..... 40/125 R, 134; 35/7 R, 35/16; D10/12 R, 12 H, 12 G

[56] References Cited

UNITED STATES PATENTS

| | | | |
|---|---|---|---|
| 1,728,731 | 9/1929 | Hayes | 40/134 |
| 3,249,994 | 5/1966 | Hill | 40/134 X |
| 3,799,550 | 3/1974 | Milana et al. | 35/1 X |
| D158,662 | 5/1950 | Hendrickson | D10/109 |

FOREIGN PATENTS OR APPLICATIONS

| | | | |
|---|---|---|---|
| 2,340 | 1904 | United Kingdom | 40/134 |
| 813,227 | 2/1937 | France | 40/134 |

*Primary Examiner*—Louis G. Mancene
*Assistant Examiner*—John F. Pitrelli
*Attorney, Agent, or Firm*—Frank J. Jordan

[57] ABSTRACT

On a floor indicating plate to be mounted within a building, the sectional forms and arrows of stairs and numerals representative of the numbers of the stairs are indicated together with numerals representative of floors by the use of only a luminous paint or both the luminous paint and a fluorescent paint. By posting such indicating plate at a prominent place in the staircase between the floors, it is facilitated for an ascender or descender to instantly and precisely judge the present personal situation in the daytime and nighttime, at the failure of electricity or the trouble of an elevator, or in any other case such as outbreak of fire. Thus, it is made possible to confine to the minimum the occurrence of unforeseen injuries which the ascender or descender has heretofore been prone to sustain especially in an emergency.

5 Claims, 2 Drawing Figures

PLATE FOR INDICATING THE FLOORS AND THE NUMBERS OF STAIRS OF A BUILDING

BACKGROUND OF THE INVENTION

This invention relates, in a broad sense, to a guide sign or a directional sign. In a narrow sense, it pertains to the so-called 'directional sign for refuge' which serves to facilitate safe, quick and appropriate refuge activities especially at the occurrence of a state of emergency.

On a conventional guide sign provided on, for example, a wall near the landing of the staircase of a building, there are indicated only numerals which represent the upper floor and the lower floor as viewed from the place of the provision of the sign. Therefore, although the ascender or descender of the staircase can readily know what floor of the building his present position belongs to, he must step on the stairs throughout in order to know the number of the stairs. It is accordingly very difficult for the ascending or descending person to precisely grasp the real condition of his course at the occurrence of a state of emergency. He becomes irritated, frightened and confused in vain. As the result, he misses his footing on the stairs to fall down and to be wounded, or prompt and daring refuge activities to the outdoors are hindered. This leads to the problem that a disastrous accident causing many casualties can be induced.

SUMMARY OF THE INVENTION

An object of this invention is to provide an indicating plate (guide plate) in which the sectional forms and arrows of stairs and numerals and letters representative of the numbers of the stairs are indicated in the middle and numerals and letters representative of upper and lower floors as viewed from the staircase are indicated above and below the sectional forms by the use of a single color or of several colors of luminous paints. It is attached onto a wall or any other prominent place near the landing of the staircase. Thus, at the normal times during the daytime and besides in cases of the trouble of an elevator, outbreak of fire, failure of electricity, etc. during the daytime, the ascender or descender of the staircase can precisely grasp the circumstances of his course owing to the colored patterns and the colored numerals and letters on the indicating plate (guide plate), and is facilitated to take appropriate action serenely and promptly. At the failure of electricity, etc. during the nighttime, the safety for the course of the ascender or descender in the dark is secured owing to the indications of the sectional forms of the stairs, the upper and lower floors as viewed from the particular position and the numbers of the stairs, the indications being attended with illumination by the luminous paints as light accumulating agents. Furthermore, in case of an emergency such as outbreak of fire in the nighttime, the ascender or descender can perform cool and quick refuge activities.

Another object of this invention is to provide the above-specified indicating plate (guide plate) in which parts (for example, contours only) of the stair sectional forms, arrows, floors, and numerals and letters representative of the numbers of the stairs are indicated by a fluorescent paint, while all the remaining parts are indicated by a luminous paint. During the daytime and the lighting of lamps, the function as both the guide sign and the directional sign is achieved by utilizing reflected light at the parts displayed by the fluorescent paint. At the failure of electricity in the nighttime, etc., the function as the guide sign is satisfactorily achieved by utilizing the light emitting illumination action of the luminous paint as a light accumulating agent at the parts displayed by the luminous paint. In this way, the occurrence of injuries caused by disorder at the occurrence of a state of emergency is prevented as far as possible.

The above-mentioned objects and further objects are accomplished by this invention as will be apparent from the following description taken with reference to the accompanying drawing constituting part of this application and from the appended claims. The drawing, however, is for elucidation only, and never restricts the scope of this invention.

BRIEF DESCRIPTION OF THE DRAWING

The drawing illustrates an embodiment of 'a plate for indicating the floors and the numbers of stairs of a building' for putting the novel concept of this invention into a concrete form.

DETAILED DESCRIPTION OF THE INVENTION

Figure 1:
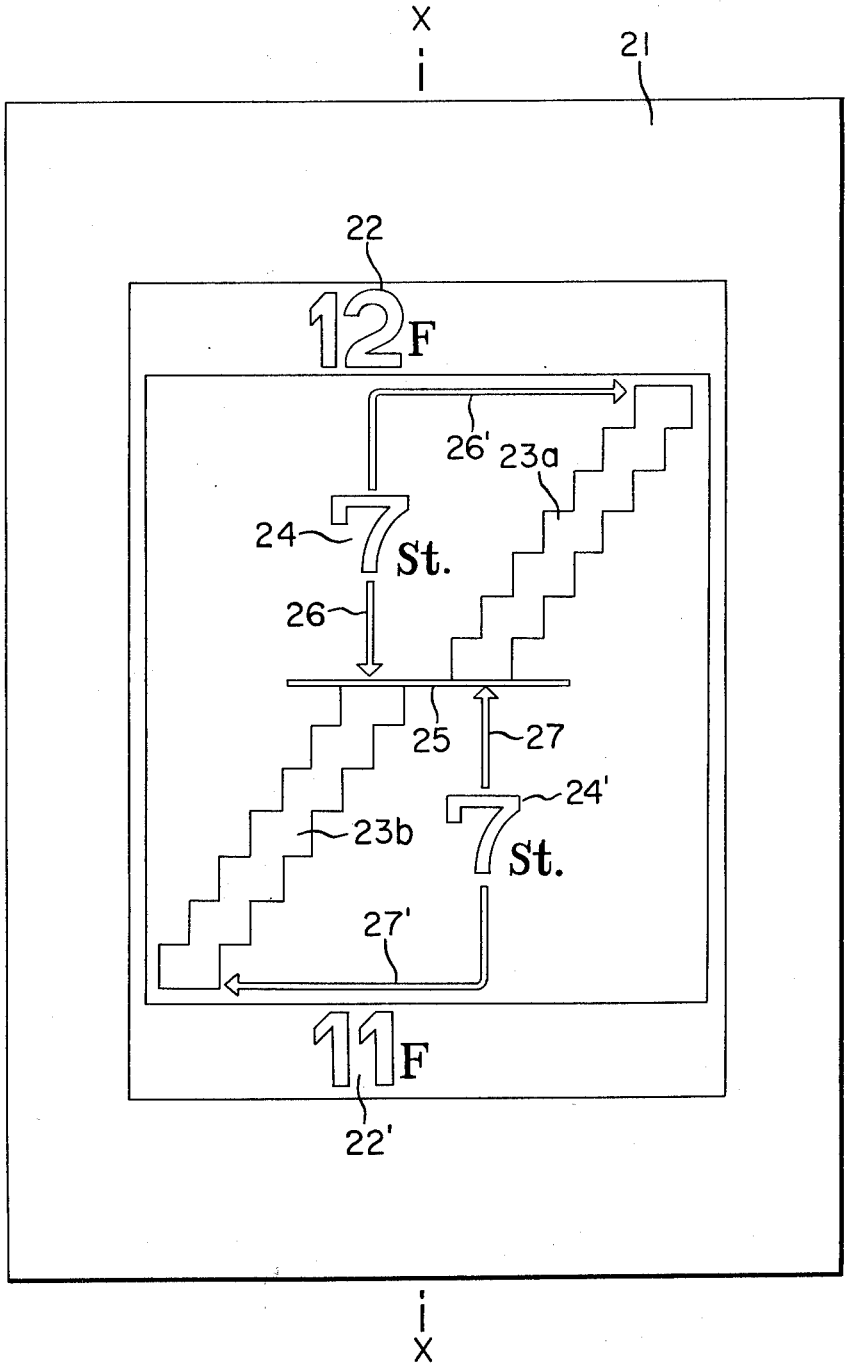
FIG. 1 is a front view of the indicating plate.
Figure 2:
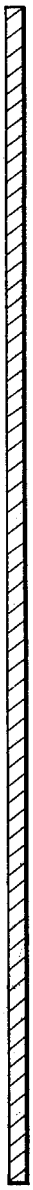
FIG. 2 is a vertical sectional view taken along a line X — X in FIG. 1.

This invention indicates the number of stairs together with floors on a floor indicating plate which is posted within a building, and causes the ascender or descender of the stairs, not only to confirm his present position, but also to accurately conjecture the actual condition of his course in the daytime, in the nighttime, at the failure of electricity, at the outbreak of fire, at the occurrence of a natural disaster such as earthquake, or in any other case. Thus, it is intended to prevent to the utmost the occurrence of injuries which the ascender or descender has hitherto been prone to sustain.

The subject matter stated above will be explained in detail hereunder in connection with an embodiment shown in the accompanying drawing.

Reference symbol 21 designates an indicating plate, which is made so as to be posted at a conspicuous place in the staircase between floors. Symbols 22 and 22' denote numerals which indicate the floors. The upper numeral 22 represents the upper floor, while the lower numeral 22' the lower floor. Symbol **23*a* shows the sectional form of the stairs from a landing 25 to the upper floor, and symbol 23*b* the sectional form of the stairs from the landing 25** to the lower floor.

The sectional form **23*a* of the stairs has arrows 26 and 26' affixed thereto in the vertical direction and horizontal direction, respectively. Likewise, the sectional form 23*b* has arrows 27 and 27' affixed thereto in the vertical direction and horizontal direction, respectively. Numerals at 24 and 24'** for representing the numbers of the stairs are respectively added to the arrows.

The stairs **23*a*, 23*b*, the landing 25, the number-of-stairs indications 24, 24', and the floor indications 22, 22'** are coated with a luminous paint singly or with both the luminous paint and a fluorescent paint so that they can be very clearly perceived even in the nighttime, at the failure of electricity, or in the like case.

FIRST EXAMPLE

In the middle of a plate body made of a metal, a synthetic resin or the like, the pair of stair sectional forms 23*a* and 23*b* above and below the landing 25; the respectively paired arrows 26, 26′ and 27, 27′ above and below the same; and the numerals and letters 24 and 24′ representative of the numbers of the stairs are indicated by coating by the use of several colors of luminous paints. Above and below the sectional forms 23*a* and 23*b*, the numerals and letters 22 and 22′ representative of the upper floor and the lower floor relative to the staircase are similarly indicated. Thus, the plate 21 for indicating the floors and the numbers of stairs is constructed. It is attached and posted on a wall or at any other prominent place near the landing of the staircase. In this way, at normal times and besides in cases of the trouble of an elevator, outbreak of fire, failure of electricity, etc. during the daytime, the ascending or descending person of the staircase is precisely informed of the circumstances of his course owing to the colored patterns 23*a*, 23*b*; 25; 26, 26′; and 27, 27′ and the colored numerals and letters 22, 22′; and 24, 24′ displayed on the surface of the indicating plate 21. It is thus facilitated to take appropriate action serenely and promptly. At the failure of electricity, etc. during the nighttime, the feeling of uneasiness for his course as the ascender or descender is prone to hold in the dark is wiped out to the utmost owing to the indications of the sectional forms 23*a*, 23*b* as well as the landing 25 of the staircase, the upper and lower floors 22 and 22′ relative to the staircase, and the numbers 24 and 24′ of the stairs, the indications being attended with illumination by the luminous paints as light accumulating agents. Particularly in case of emergency such as outbreak of fire in the nighttime, the ascending or descending person can efficiently perform calm, cool and quick refuge activities.

SECOND EXAMPLE

Parts (for example, contours only) of the stair sectional forms 23*a*, 23*b*, arrows 26, 26′; 27, 27′, floors 22, 22′ and numerals and letters representing the numbers of the stairs 24, 24′ in the indicating plate 21, and a blank part except the numerals and letters 22, 22′ representative of the floors in the floor indicating space surrounding the patterns are indicated by a fluorescent paint. All the remaining parts are formed by coating with a luminous paint. Then, during the daytime and the lighting of lamps, the guide and directional sign function can be effected by utilizing reflected light at the parts displayed by the fluorescent paint. On the other hand, at the failure of electricity in the nighttime, etc., the guide sign function can be satisfactorily effected by utilizing the light emitting illumination action of the luminous paint as a light accumulating agent at the parts displayed by the luminous paint. In consequence, even at the sudden occurrence of a state of emergency, etc., the ascender or descender can readily estimate and judge the real condition of his course, and hence, he is neither irritated nor confused in most cases. Accordingly, it is not too much to say that there is substantially no fear of the injuries of the body and life due to deliration.

The indicating plate 21 constructed as described above is posted at a conspicuous place in the staircase between the floors. It can, not only indicate the floor of the position, but also clearly represent the number of the stairs. As the result, the ascender or descender can easily guess and foresee the actual condition of his course, and he never becomes terrified, astonished, excited or confused even at the failure of electricity in the nighttime, etc. Accordingly, there is substantially no such fear that he will miss his footing on the stairs. Especially, in case of the sudden occurrence of a state of emergency such as fire and earthquake or the occurrence of an accident such as unusability of an elevator, it is facilitated to secure safety for the use of the staircase and to accomplish quick and appropriate cares and besides to make the refuge activities more perfect. Thus, unforeseen losses for lives and property to suffer are confined to the minimum. The invention has such extraordinarily various effects. The effects are particularly remarkable at the exit and entrance staircases of a building, school, hospital, theater or any other huge structure, and station precincts, underground market or subway into and from which many people usually go and come.

The concrete aspects of performance stated above, merely exemplifies the technical contents of the invention of this application. This invention ought not to be narrowly construed upon restriction to the foregoing examples (embodiment) only, but it can be variously modified and performed within the scope of the appended claims without departing from the spirit of this invention.

I claim:

1. A safety plate for installation in a building staircase or the like comprising stair indicating means on a generally central portion of said plate depicting a cross sectional representation of the actual stairs in said staircase between floors at one location in said staircase where said safety plate is installed, numerical indicating means on said plate indicating the actual number of stairs between floors in said staircase at said one location, arrow indicating means on said plate positioned to relate said numerical indicating means to said stair indicating means so that the number of actual stairs between floors in said staircase at said one location are readily depicted by and discerned from said stair indicating means, said numerical indicating means and said arrow indicating means, lower floor indicating means on a lower portion of said plate indicating the actual floor of said building at the foot of the actual stairs at said one location, upper floor indicating means on an upper portion of said plate indicating the actual floor of said building at the head of the actual stairs at said one location, all of said means comprising a luminous paint viewable under unlighted conditions of said staircase such that the plate is adapted to be viewed by a stair ascender or descender under said unlighted condition to guide said ascender or descender in negotiating said staircase under emergency conditions or the like.

2. A safety plate according to claim 1 wherein at least some of said means further comprises fluorescent paint to facilitate viewing thereof under lighted conditions in said staircase.

3. A safety plate according to claim 1 wherein said stair indicating means depicts a cross sectional representation of a mid-floor landing included on the actual stairs in said staircase at said one location, said numerical indicating means including an upper portion indicating the actual number of stairs between said mid-floor landing and the head of the actual stairs at said one location and a lower portion indicating the actual number of stairs between said mid-floor landing and the foot of said actual stairs at said one location.

4. A safety plate according to claim 3 wherein said arrow indicating means comprises vertical arrows including an upper vertical arrow terminating at said mid-floor landing of said stair indicating means and a lower vertical arrow terminating at said mid-floor landing of said stair indicating means.

5. A safety plate according to claim 4 wherein said arrow indicating means comprises horizontal arrow indicating means including an upper horizontal arrow joined to said upper vertical arrow and a lower horizontal arrow joined to said lower vertical arrow.

* * * * *